United States Patent [19]

Vanover et al.

[11] 4,170,871

[45] Oct. 16, 1979

[54] BRACELET LINKAGE

[75] Inventors: Wallace F. Vanover; Kurt A. Rieth, both of Warwick, R.I.

[73] Assignee: Textron, Inc., Providence, R.I.

[21] Appl. No.: 933,963

[22] Filed: Aug. 15, 1978

[51] Int. Cl.[2] ..... A44C 5/10

[52] U.S. Cl. ..... 59/82

[58] Field of Search ..... 59/80, 82, 78, 91, 35; 63/4, 26

[56] References Cited

U.S. PATENT DOCUMENTS

| | | | |
|---|---|---|---|
| 1,556,465 | 10/1925 | Wendel | 63/26 |
| 1,589,423 | 6/1926 | Payton | 59/80 |
| 1,701,610 | 2/1929 | Forstner | 59/80 |
| 1,844,606 | 2/1932 | Selikoff | 63/26 |
| 1,847,901 | 3/1932 | Roy | 59/80 |
| 1,854,958 | 4/1932 | Santosuosso | 63/28 |
| 2,073,280 | 3/1937 | Lederer | 40/156 |
| 2,136,818 | 11/1938 | Kestenman | 59/80 |
| 2,143,703 | 1/1939 | Kestenman | 59/80 |
| 2,510,774 | 6/1950 | Engel | 63/26 |
| 2,536,391 | 1/1951 | Prestinari | 59/80 |

*Primary Examiner*—Francis S. Husar
*Assistant Examiner*—Gene P. Crosby
*Attorney, Agent, or Firm*—Thompson, Birch, Gauthier & Samuels

[57] ABSTRACT

A bracelet linkage comprising a plurality of link assemblies each of which includes a thin outer shell having a central opening and a pair of bendable tab means extending downwardly from the central portions of the ends of its outer wall. Each link assembly also includes an inner member having a central opening of substantially the same size as the central opening of the outer shell. Each end member of each inner member includes first groove means which extends inwardly from its central portion and second groove means which extends inwardly from the bottom wall of the first groove means and then from the first groove means towards the adjacent portion of the central opening of the inner member for receiving the bendable tab means so that the outer shell is secured to the inner member by the tab means and end portions of the tab means are positioned at least in the second groove means. The linkage also includes a plurality of connector links each of which extends through adjacent ends of the openings of the adjacent outer shells and inner members and about said bendable tab means whereby the tab means are concealed.

10 Claims, 17 Drawing Figures

BRACELET LINKAGE

BACKGROUND OF THE INVENTION

There has been a long-felt need for a bracelet linkage in which each link assembly has a central opening and consists of only two parts, one of which is a thin outer shell made of gold filled, rolled gold plate, stainless steel or other ornamental material and the other of which is made of non-precious metal material such as stainless steel. The long-felt need also includes such a linkage in which the outer shell can be provided with a wide selection of ornamental designs. The long-felt need also includes such a linkage which is durable, the parts of which are economical to manufacture and which is economical to assemble.

While Roy U.S. Pat. No. 1,847,901 dated Mar. 1, 1932 discloses a bracelet linkage which consists of a series of solid body links 10 each of which has a central opening, connected together in end-to-end relationship by inner connecting links 12 and superimposed outer connecting links 19, because the body links are solid it would be impossible to economically emboss them with different ornamental designs and it would be very expensive to make them of precious metal such as gold-filled or silver materials. Furthermore because two separate connecting links are used, it would be very expensive to connect the links together.

While Santosuosso U.S. Pat. No. 1,854,958 dated Apr. 19, 1932 discloses a gem mounting which consists of an outer box member 4 and an internal tray or gem carrier 1 secured together by end tabs 8, the end portions of these tabs are positioned below the bottom surface of the internal tray and, because the central opening of the outer box is filled with gems, it would be impossible to connect a series of such mountings together in end-to-end relationship to form a bracelet.

Other prior patents which disclose products which have not met the long-felt needs are:

Wendel U.S. Pat. No. 1,556,465 dated Oct. 6, 1925;
Forstner U.S. Pat. No. 1,701,610 dated Feb. 16, 1929;
Selikoff U.S. Pat. No. 1,844,606 dated Feb. 9, 1932;
Lederer U.S. Pat. No. 2,073,280 dated Mar. 9, 1937;
Kestenman U.S. Pat. No. 2,136,818 dated Nov. 15, 1938; and
Engel U.S. Pat. No. 2,510,774 dated June 6, 1950.

The above identified prior art is the closest prior art of which we are aware to a bracelet linkage embodying our invention as described and claimed in this application.

BRIEF SUMMARY OF THE INVENTION

One object of the invention is to provide a bracelet linkage which can be easily provided with a wide selection of design variations.

Another object is to provide such a linkage which is economical to manufacture.

A further object is to provide such linkage which is durable in use. A still further object is to provide such a linkage which is attractive in appearance.

Another object is to provide such a linkage the visible parts of which can be made economically of gold filled, rolled gold or other precious metal containing materials.

A further object is to provide such a linkage the non-visible parts of which can be made economically of a non-precious and non-corrosive material stainless steel.

Yet another object is to provide such a linkage in which each link assembly is made of only two parts.

Further objects and advantages of this invention will be apparent to persons skilled in the art from the following description taken in conjunction with the accompanying drawings.

In general a linkage embodying this invention includes a plurality of link assemblies each of which comprises a thin outer shell which includes an outer wall having a central transverse opening, side flange means extending downwardly from the sides of the outer wall, end flange means extending downwardly from the ends of the outer wall, and a pair of bendable tab means extending downwardly from the central portions of the end flange means.

Each link assembly also comprises an inner member which includes a bottom wall having a central transverse opening of substantially the same size as the central opening of the outer shell, a pair of side members extending upwardly from the bottom wall, and a pair of end members extending between the side members. The inner member also includes a pair of first groove means one extending inwardly from each of the central portions of its end members, and a pair of second groove means one extending inwardly from the bottom wall of each of the first groove means towards the adjacent portion of the central opening of the bottom wall.

The outer shell is secured to the inner member by inserting the bendable tab means in the first groove means and bending their lower ends thru the second groove means and about the adjacent portions of the end members of the inner member.

The bracelet linkage also includes means for connecting a plurality of the link assemblies together in end-to-end relationship.

In one embodiment the outer shell also includes inner flange means which extend downwardly from its outer wall forming downwardly extending side walls of its transverse opening.

In one embodiment the inner member is a solid member which is substantially thicker than the thin outer shell.

In another embodiment the inner member is a thin shell.

In a preferred embodiment the first groove means are formed by bending the central portions of the end members of the inner member inwardly.

In a preferred embodiment the second groove means are formed by cutting away the lower central portions of the end portions of the end members of the inner members.

In a further embodiment the thin outer shell also includes a pair of third groove means one extending inwardly from each of the central portions of the end flange means of the outer shell, and the inner surfaces of the walls of these third groove means extend into the first groove means.

In a preferred embodiment the side and end flange means of the outer shell are in face-to-face relationship with the side and end members of said inner member.

In yet another embodiment the means for connecting a plurality of the link assemblies together includes a plurality of connector links each of which extends through adjacent ends of the central openings of adjacent outer shells and inner members and about the bendable tab means whereby the bendable tab means are concealed.

In another preferred embodiment the means for connecting a plurality of link assemblies together includes a plurality of connector links each of which extends through adjacent ends of the openings of adjacent outer shells and inner members, into the third groove means and about the bendable tab means so that the outer surfaces of the end portions of the connector links are substantially flush with the outer surfaces of the end flange means of the outer shells.

It will be apparent to persons skilled in the art that this invention has solved the above described long-felt needs and satisfied the above described objects.

DETAILED DESCRIPTION OF THE FIRST EMBODIMENT OF THE INVENTION

Figure 1:
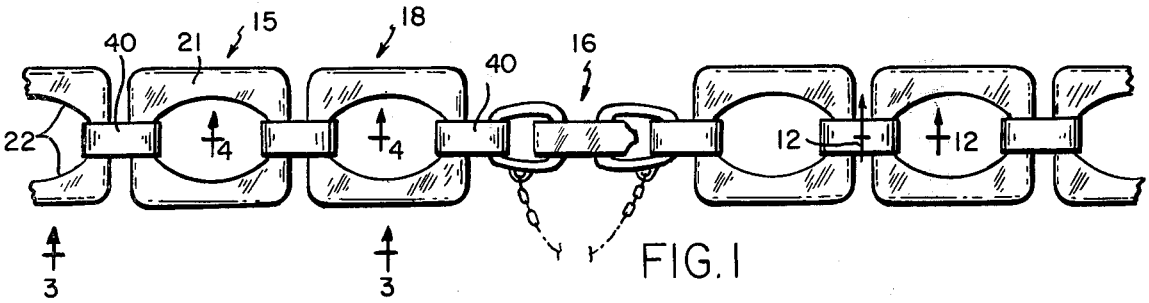
FIG. 1 is a plan view of a first embodiment of a bracelet linkage embodying the invention.

Referring now to the drawings, a linkage for a bracelet embodying the invention is generally indicated by the numeral 15. It has general application to a wrist watch bracelet, an identification bracelet or the like.

In the embodiment shown in the drawings two linkages are shown, the adjacent ends of which are secured together by a clasp 16 which may be of any well known prior art construction. When used as a wrist watch bracelet the other ends of the bracelet linkages are secured by end connectors (not shown) to the lugs of a wrist watch (not shown). The clasp 16 can be opened to permit a wrist watch and bracelet linkage to be slipped over the hand of the user and closed to detachably hold the bracelet and wrist watch about the wrist of the wearer.

Each link assembly 18 comprises a thin outer shell 20 which may be made of gold-filled, rolled gold plate or stainless steel materials of about 0.010" in thickness. It can be easily embossed with selected designs or textures to provide an ornamental surface for its outer wall 21. The outer shell 20 is provided with a central opening 22. The side walls of this opening may be formed by the inner flanges 23 which extend downwardly from the outer wall 21.

The outer shell also comprises side flanges 24 which extend downwardly from the sides of the outer wall 21.

The end flange means 26 extending downwardly from the ends of the outer wall. A pair of bendable tab means 25 extend downwardly from the central portions of the end flange means.

Each link assembly also includes a solid inner member 30 which is substantially thicker than the thin outer shell 20. This solid inner member may be stamped from a stainless steel strip which is about 0.062" thick. It is provided with a central opening 31 which is of substantially the same size as the central opening 22 of the outer shell. The flanges 23 of the outer shell are in face-to-face relationship with the side walls of the central opening 31.

The end members 34 of the inner member are provided with a pair of first groove means 35 which extend inwardly from the central portions of the end members.

A pair of second groove means 33 are provided extending inwardly from the bottom walls of the first groove means towards the adjacent portions of the central opening 31 of the inner member.

Figure 6:
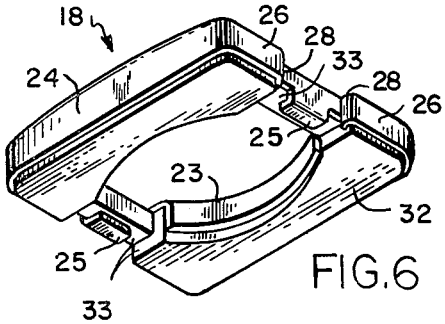
FIG. 6 is an enlarged isometric view of the assembled outer shell and solid inner member.
Figure 7:
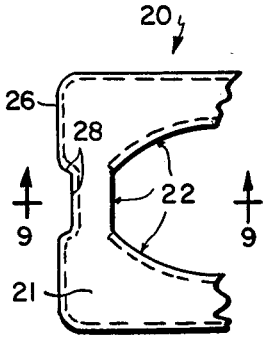
FIG. 7 is an enlarged top plan view of the outer shell with one end broken away.
Figure 8:
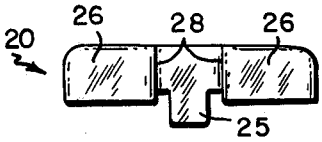
FIG. 8 is an end elevational view looking from left to right at the outer shell shown in FIG. 7.
Figure 9:
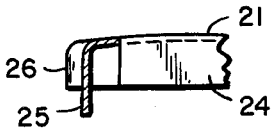
FIG. 9 is a section on the lines 9—9 of FIG. 7.
Figure 12:
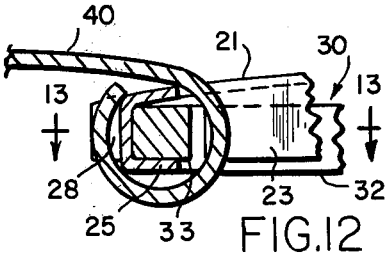
FIG. 12 is an enlarged section on the lines 12—12 of FIG. 1.
Figure 10:
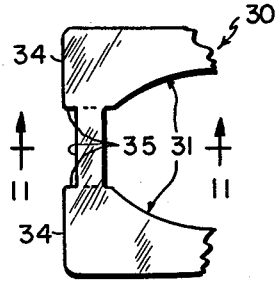
FIG. 10 is a top plan view of the solid inner member shown in FIG. 5 with one end broken away.
Figure 11:
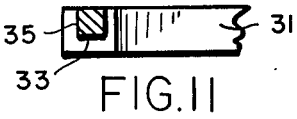
FIG. 11 is a section on the lines 11—11 of FIG. 10.

These second groove means receive the end portions of the bendable tab means 25 when the outer shell is assembled with the solid inner member as shown in FIGS. 6 and 12.

Figure 13:
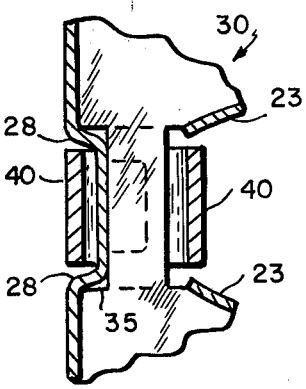
FIG. 13 is a section on the lines 13—13 of FIG. 12.

The thin outer shell 20 is provided with a pair of third groove means 28 one extending inwardly from each of the central portions of the end flange means 26. The inner surface of the third groove means extends into the first groove means 35 as best shown in FIG. 13.

The inner flange means 23 of the outer shell may be omitted without departing from the invention in its broad aspect.

Each link assembly 18 is made of only two parts namely the outer shell 20 and the solid inner member 30.

Figure 2:
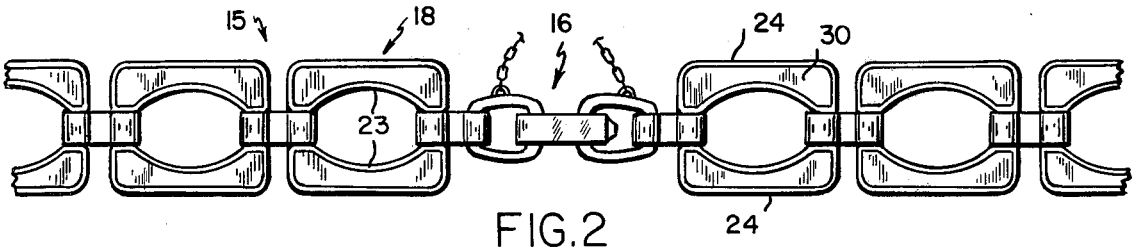
FIG. 2 is a bottom view of the linkage shown in FIG. 1.
Figure 3:
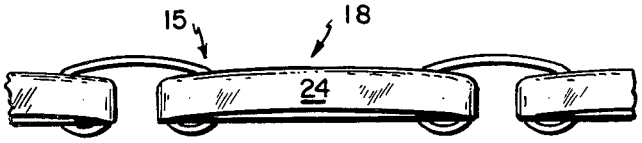
FIG. 3 is an enlarged side elevation of the linkage shown in FIG. 1 looking in the direction of the arrows 3 of FIG. 1.
Figure 4:
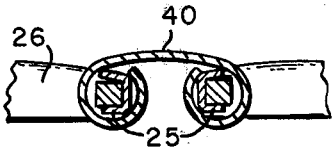
FIG. 4 is an enlarged section on the lines 4—4 of FIG. 1.
Figure 5:
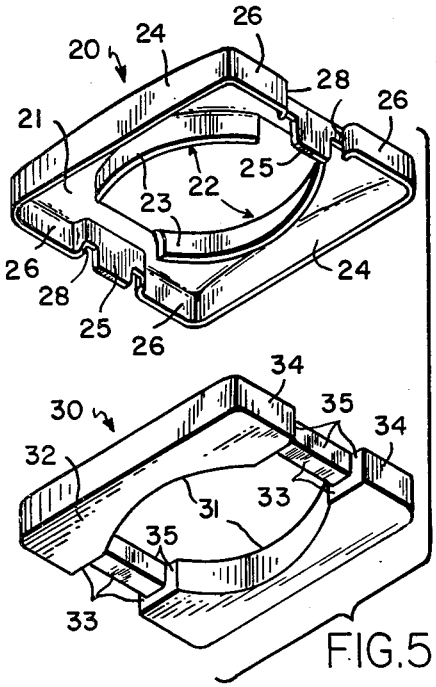
FIG. 5 is an enlarged exploded isometric view showing the thin outer shell in a position to be assembled with the solid inner member of a link assembly embodying the invention.

The link assembles 18 are connected together in end-to-end relationship to form a linkage for a bracelet by connecting links 40. These connecting links are made of gold filled or rolled gold plate on a pure nickel base or stainless steel materials and are about 0.15" in thickness. As shown in FIGS. 1, 4, 12 and 13, they extend through the adjacent ends of the openings 22 of adjacent outer shells and inner members, into the third groove means 28 and about the bendable tab means 25 and their end portions are positioned in the third groove means 28 and are substantially flush with the outer surfaces of the end portions of the end flange means 26 of the the outer shells. They conceal the bendable tab means as best shown in FIGS. 2, 4 and 12.

Bracelet linkages embodying the first embodiment of this invention have satisfied the above described objects and have provided the above described advantages.

DETAILED DESCRIPTION OF THE SECOND EMBODIMENT OF THE INVENTION

Figure 14:
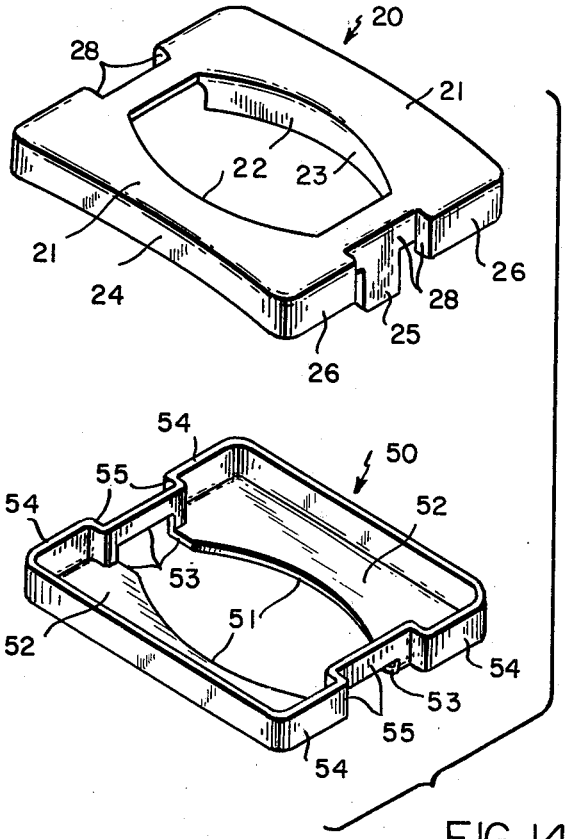
FIG. 14 is an enlarged exploded isometric view showing a thin outer shell in a position to be assembled with a thin inner member of a second embodiment of the invention.
Figure 15:
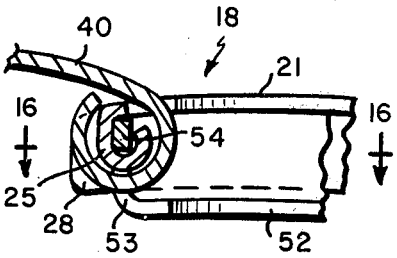
FIG. 15 is an enlarged section showing one end of a link assembly and one end of a connector link for connecting a pair of link assemblies of the second embodiment together in end-to-end relationship like the connector link of the first embodiment.
Figure 16:
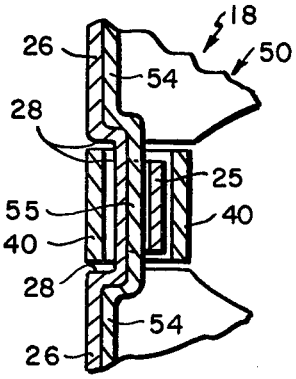
FIG. 16 is a section on the line 16—16 of FIG. 15.

The second embodiment of the invention is shown in FIGS. 14, 15 and 16 of the drawings.

The thin outer shell 20 of this second embodiment is of the same construction and may be made of the same materials as the thin outer shell 20 of the first embodiment. Consequently we have used the same numerals to designate the respective elements of the outer shell of the second embodiment as were used to designate them in the first embodiment.

The inner member 50 of the second embodiment is similar to the inner member 30 of the first embodiment except that it is a thin shell rather than a relatively thick member. Preferably it is made of stainless steel of about 0.010" in thickness.

The inner member 50 is provided with a central opening 51 which is of substantially the same size as the central opening 22 of the outer shell. The flanges 23 of the outer shell are in face-to-face relationship with the side walls of the central opening 51.

The end members 54 of the inner member are provided with a pair of first groove means 55 which extend inwardly from the central portions of the end members. These groove means are formed by bending or forming the central portions of the end members 54 inwardly.

A pair of second groove means 53 are provided extending inwardly from the bottom walls of the first groove means 55 towards the adjacent portions of the central opening 51 of the inner member. They are formed by cutting or punching away the lower central portions of the end members 54 of the inner member.

These second groove means receive the end portions of the bendable tab means 25 when the outer shell is assembled with the inner member as shown in FIG. 15.

The thin outer shell 20 is provided with a pair of third groove means 28 one extending inwardly from each of the central portions of the end flange means 26. The inner surface of the third groove means extends into the first groove means 55 as best shown in FIG. 16.

Each link assembly 18 is made of only two parts, namely the outer shell 20 and the thin inner member 50.

The link assemblies are connected together in end-to-end relationship to form a linkage for a bracelet by connecting links 40. These connecting links are made of gold filled or rolled gold plate on a pure nickel base or stainless steel materials and are about 0.15" in thickness. As shown in FIGS. 1 and 4 of the first embodiment and 15 and 16 of the second embodiment, they extend through the adjacent ends of the openings 22 of adjacent outer shells and inner members, into the third groove means 28 and about the bendable tab means 25 and their end portions are positioned in the third groove means 28 and are substantially flush with the outer surfaces of the end portions of the end flange means 26 of the outer shells. They conceal the bendable tab means as best shown in FIG. 15.

Bracelet linkages embodying the second embodiment of this invention have satisfied the above described objects and have provided the above described advantages.

Figure 17:
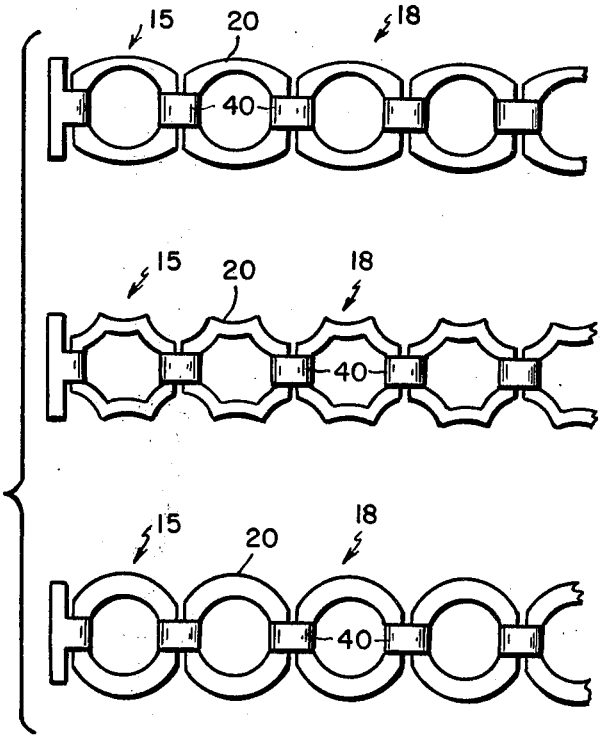
FIG. 17 is a plan view showing three other designs of bracelet linkages which may embody either the first or the second embodiments of the invention as desired.

As shown in FIG. 17 bracelet linkages 15 embodying the invention of either the first or second embodiment which have link assemblies 18 of other exterior designs may be substituted for the generally rectangular exterior design of the link assemblies shown in FIGS. 1 thru 16 of the drawings.

While five embodiments of bracelet linkages embodying the invention have been shown in the drawings and described in the specification, it is to be understood that this disclosure is for the purpose of illustration only and that various changes in shape, proportion and arrangement of parts as well as the substitution of equivalent elements for those shown and described herein may be made without departing from the spirit and scope of the invention as set forth in the appended claims.

We claim:

1. A bracelet linkage comprising a plurality of link assemblies each of which comprises, a thin outer shell comprising, an outer wall having a central transverse opening, side flange means extending downwardly from the sides of said outer wall, end flange means extending downwardly from the ends of said outer wall, and a pair of bendable tab means extending downwardly from the central portions of said end flange means, an inner member comprising, a bottom wall having a central transverse opening of substantially the same size as the central opening of said outer shell, a pair of side members extending upwardly from said said bottom wall, a pair of end members extending between said side members, a pair of first groove means one extending inwardly from each of the central portions of said end members, and a pair of second groove means one extending inwardly from the bottom wall of each of said first groove means towards the adjacent portion of the central opening of the bottom wall, said outer shell being secured to the inner member by inserting said bendable tab means in said first groove means and bending their lower ends thru said second groove means and about the adjacent portions of the end members of the inner member, and means for connecting a plurality of said link assemblies together in end-to-end relationship to form a linkage for a bracelet.

2. A linkage according to claim 1 wherein said outer shell also comprises inner flange means extending downwardly from said outer wall of the outer shell forming downwardly extending side walls of its transverse opening.

3. A linkage according to claim 1 wherein said inner member is a solid member which is substantially thicker than the thin outer shell.

4. A linkage according to claim 1 wherein the side and end flange means of said outer shell are in face-to-face relationship with the side and end members of said inner member.

5. A linkage according to claim 1 wherein said means for connecting a plurality of said link assemblies together comprises a plurality of connector links each of which extends through adjacent ends of the central openings of adjacent outer shell and inner members and about said bendable tab means whereby said bendable tab means are concealed.

6. A linkage according to claim 1 wherein said inner member is a thin shell.

7. A linkage according to claim 6 wherein said first groove means are formed by bending the central portions of the end members of the inner member inwardly.

8. A linkage according to claim 7 wherein said second groove means are formed by cutting away the lower central portions of the end portions of the end members of the inner member.

9. A linkage according to claim 1 wherein the thin outer shell also comprises a pair of third groove means one extending inwardly from each of the central portions of said end flange means of the outer shell, and the inner surfaces of the walls of said third groove means extend into said first groove means.

10. A linkage according to claim 9 wherein said means for connecting a plurality of said link assemblies together comprises a plurality of connector links each of which extends through adjacent ends of the openings of adjacent outer shells and inner members, into said third groove means and about said bendable tab means, whereby the outer surfaces of the end portions of the connector links are substantially flush with the outer surfaces of the end flange means of the outer shells.

* * * * *